US010789926B2

(12) United States Patent
Sato et al.

(10) Patent No.: US 10,789,926 B2
(45) Date of Patent: Sep. 29, 2020

(54) SUPPORTING APPARATUS FOR KICK PAD

(71) Applicant: Pearl Musical Instrument Co., Yachiyo-shi (JP)

(72) Inventors: Yuichi Sato, Yachiyo (JP); Takashi Koizumi, Yachiyo (JP); Akito Takegawa, Yachiyo (JP)

(73) Assignee: Pearl Musical Instrument Co. (JP)

( * ) Notice: Subject to any disclaimer, the term of this patent is extended or adjusted under 35 U.S.C. 154(b) by 0 days.

(21) Appl. No.: 16/383,725

(22) Filed: Apr. 15, 2019

(65) Prior Publication Data

US 2019/0318716 A1 Oct. 17, 2019

(30) Foreign Application Priority Data

Apr. 16, 2018 (JP) ..... 2018-078213

(51) Int. Cl.

| | |
|---|---|
| ***G10D 13/02*** | (2020.01) |
| ***G10H 3/14*** | (2006.01) |
| ***G10D 13/11*** | (2020.01) |
| ***G10D 13/10*** | (2020.01) |

(52) U.S. Cl.

CPC ..... *G10H 3/143* (2013.01); *G10D 13/02* (2013.01); *G10D 13/11* (2020.02); *G10D 13/26* (2020.02); *G10H 3/146* (2013.01); *G10H 2220/525* (2013.01); *G10H 2230/291* (2013.01)

(58) Field of Classification Search

CPC .. G10H 3/143; G10H 3/146; G10H 2220/525; G10H 2230/291; G10D 13/006; G10D 13/024

USPC ..... 84/422.1

See application file for complete search history.

(56) References Cited

U.S. PATENT DOCUMENTS

| | | | | |
|---|---|---|---|---|
| 8,039,724 | B1 | 10/2011 | Norman et al. | |
| 8,178,769 | B2 * | 5/2012 | Steele | G10D 13/026 84/421 |
| 9,257,106 | B2 | 2/2016 | Wei | |
| 2008/0264233 | A1 * | 10/2008 | Gatzen | G10D 13/022 84/411 M |

* cited by examiner

*Primary Examiner* — Jianchun Qin

(74) *Attorney, Agent, or Firm* — Harness, Dickey & Pierce, P.L.C.

(57) ABSTRACT

A supporting apparatus (40) for a kick pad (1) includes a supporting frame (41~44) that supports a kick pad (1) including a piezoelectric element that converts a vibration generated by beating with a beater into an electric signal and outputs the electric signal, and a fixation frame (51, 52) that fixes the supporting apparatus (40) to an inner surface of a shell of a bass drum while a striking surface (2*a*) of the kick pad (1) is arranged in a position beaten by the beater.

2 Claims, 8 Drawing Sheets

SUPPORTING APPARATUS FOR KICK PAD

CROSS-REFERENCE TO RELATED APPLICATIONS

This application is based upon and claims the benefit of priority from Japanese Patent Application No. 2018-078213, filed Apr. 16, 2018; the entire contents of which are incorporated herein by reference.

BACKGROUND

1. Field

The present invention relates to, for example, a supporting apparatus designed to attach a kick pad of an electronic drum to an acoustic drum.

2. Description of the Related Art

In recent years, there is an increasing demand for attaching a kick pad of an electronic drum to an acoustic drum. Examples known as this type of kick pad include an apparatus in which a kick pad is attached to a head of a bass drum, and an apparatus in which a kick pad fixed to a stand is placed in front of a head.

However, when a kick pad is attached to a head or placed in front of the head, as in the above-described conventional apparatuses, the thickness of the bass drum increases by the thickness of the kick pad, causing the bass drum to jut out forward and increasing the space for installation of the drum set.

SUMMARY

An object of the present invention is to provide a supporting apparatus for a kick pad of an electronic drum that allows the kick pad to be attached to an acoustic drum, without increasing the installation space for the drum set.

The supporting apparatus for a kick pad according to an embodiment of the present invention includes: a supporting member that supports a kick pad including a sensor that converts a vibration generated by beating with a beater into an electric signal and outputs the electric signal; and a fixation member that fixes the supporting member to an inner surface of a body of a bass drum while a striking surface of the kick pad is arranged in a position beaten by the beater.

By using the supporting apparatus for a kick pad according to an embodiment of the present invention, it is possible to attach a kick pad to an inside of a bass drum, thus allowing a kick pad of an electronic drum to be attached to an acoustic drum, without increasing the installation space for the drum set.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Hereinafter, embodiments of the present invention will be described with reference to the accompanying drawings.

Figure 1:
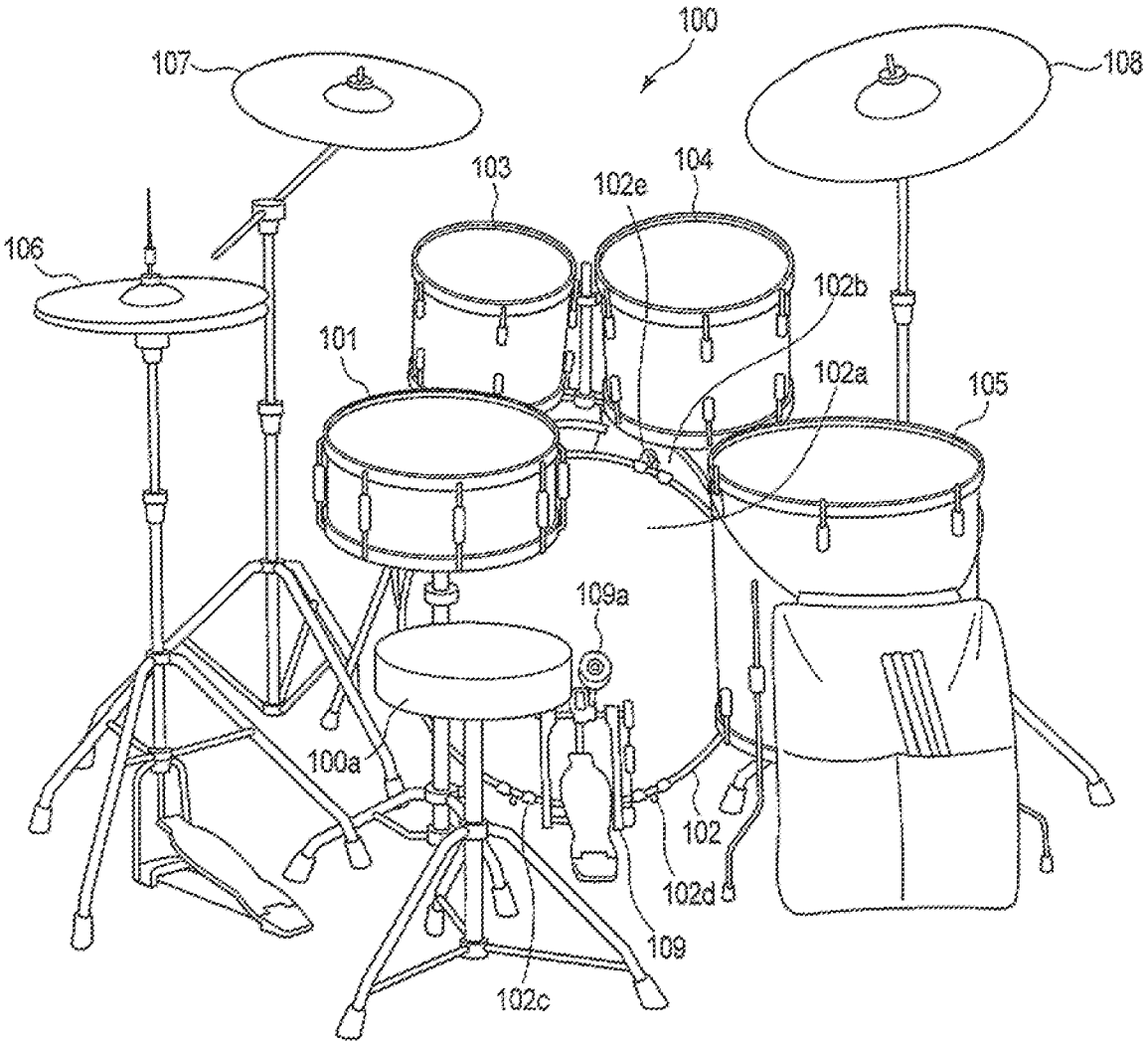
FIG. 1 is an external view of a set of acoustic drums as viewed from the player side.

FIG. 1 is an external view of a set 100 of acoustic drums (hereinafter referred to as a drum set 100) as viewed from the player side (front side). Typically, the drum set 100 includes a snare drum 101, a bass drum 102, a high tom 103, a low tom 104, a floor tom 105, a hi-hat cymbal 106, a crash cymbal 107, and a ride cymbal 108.

A stool 100*a* on which a player is seated is set up on the front side of the drum set 100. Also, a foot pedal 109 that is operated with the foot of the player seated on the stool 100*a* is provided on the front side of the bass drum 102. The foot pedal 109 includes a beater 109*a* designed to beat a head 102*a* of the bass drum 102. The foot pedal 109 is attached to a hoop 102*c* on the front side of the bass drum 102. Since matters such as the configuration of the foot pedal 109 and the method of attaching the foot pedal 109 to the hoop 102*c* are well-known in the art, a detailed description of such matters will be omitted herein.

Figure 2:
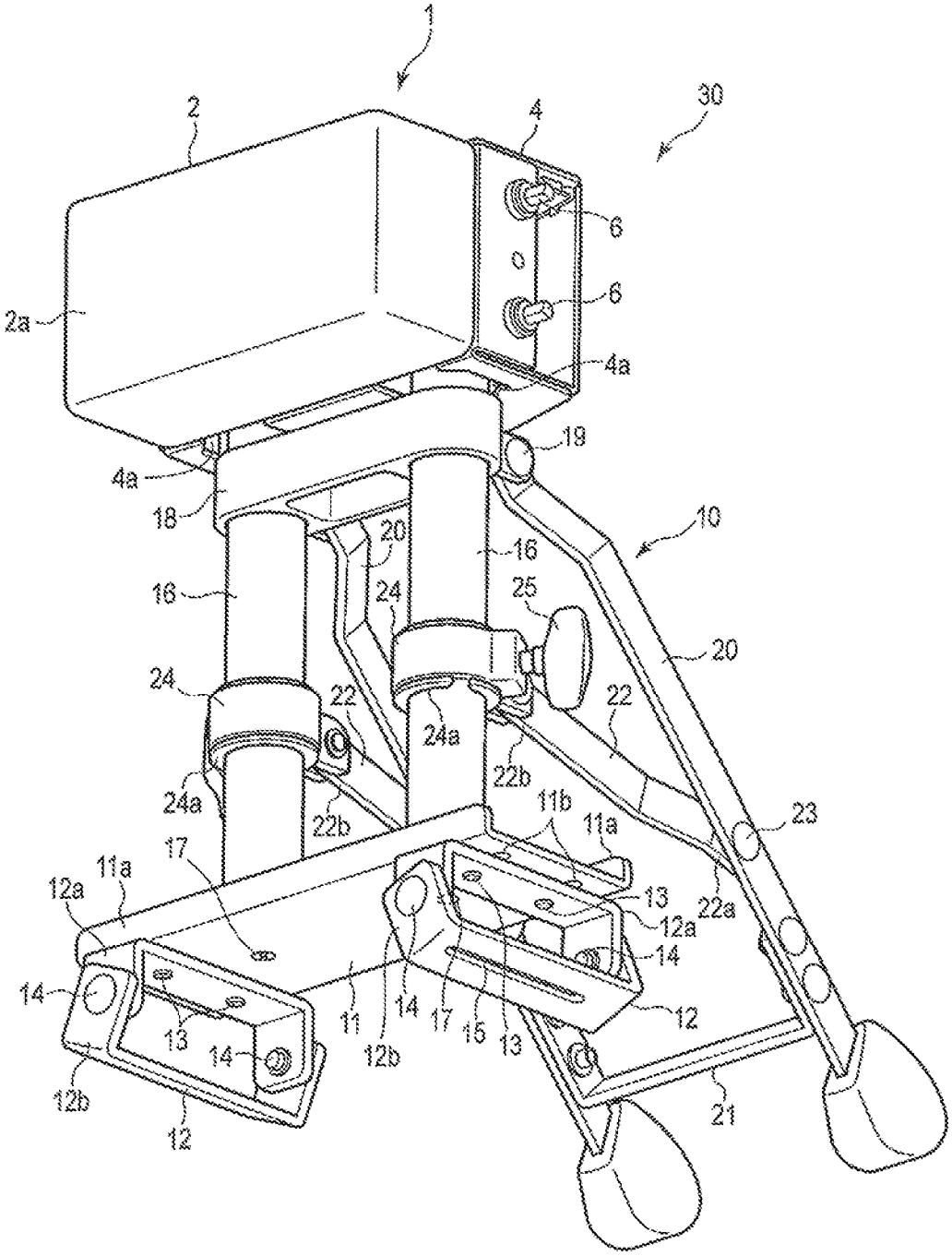
FIG. 2 is an external perspective view showing an assembly in which a kick pad to be installed inside a bass drum shown in FIG. 1 is attached to a supporting apparatus, according to a first embodiment.

In the bass drum 102, namely, inside the head 102*a*, an assembly 30 that supports a kick pad 1 of an electronic drum by means of a supporting apparatus 10 according to a first embodiment is arranged. FIG. 2 is an external perspective view of an assembly 30. In FIG. 1, illustration of the assembly 30 is omitted. The kick pad 1 is arranged in a position beaten by the beater 109*a* via the head 102*a*, using the supporting apparatus 10 of the present embodiment.

With the kick pad 1, the bass drum 102 functions as an electronic drum. Accordingly, the head 102*a* on the player side, which is required in an acoustic drum, can be omitted. That is, it is also possible to directly beat the striking surface of the kick pad 1 with the beater 109*a*.

However, when the head 102*a* is provided, as in the present embodiment, the same tension as would be applied when the bass drum 102 is used an acoustic drum will not be applied to the head 102*a*. That is, it is desirable that the head 102*a* is attached under a tension that does not cause the head 102*a* to apply a bounce-back force to the beater 109*a* when the kick pad 1 is beaten with the beater 109*a*. Alternatively, the head 102*a* may be formed of a mesh material against which the beater 109*a* weakly bounces back, and attached in a loosely stretched state.

Alternatively, the head 102*a* may be formed of a plastic film or genuine leather and provided on the front side of the bass drum 102. In this case, the head 102*a* may be held under the same tension as that of an acoustic drum, if the striking sound of the beater 109*a* may become louder. In either case, it is desirable that the head 102*a* is provided in proximity to or in contact with the striking surface of the kick pad 1.

Figure 3:
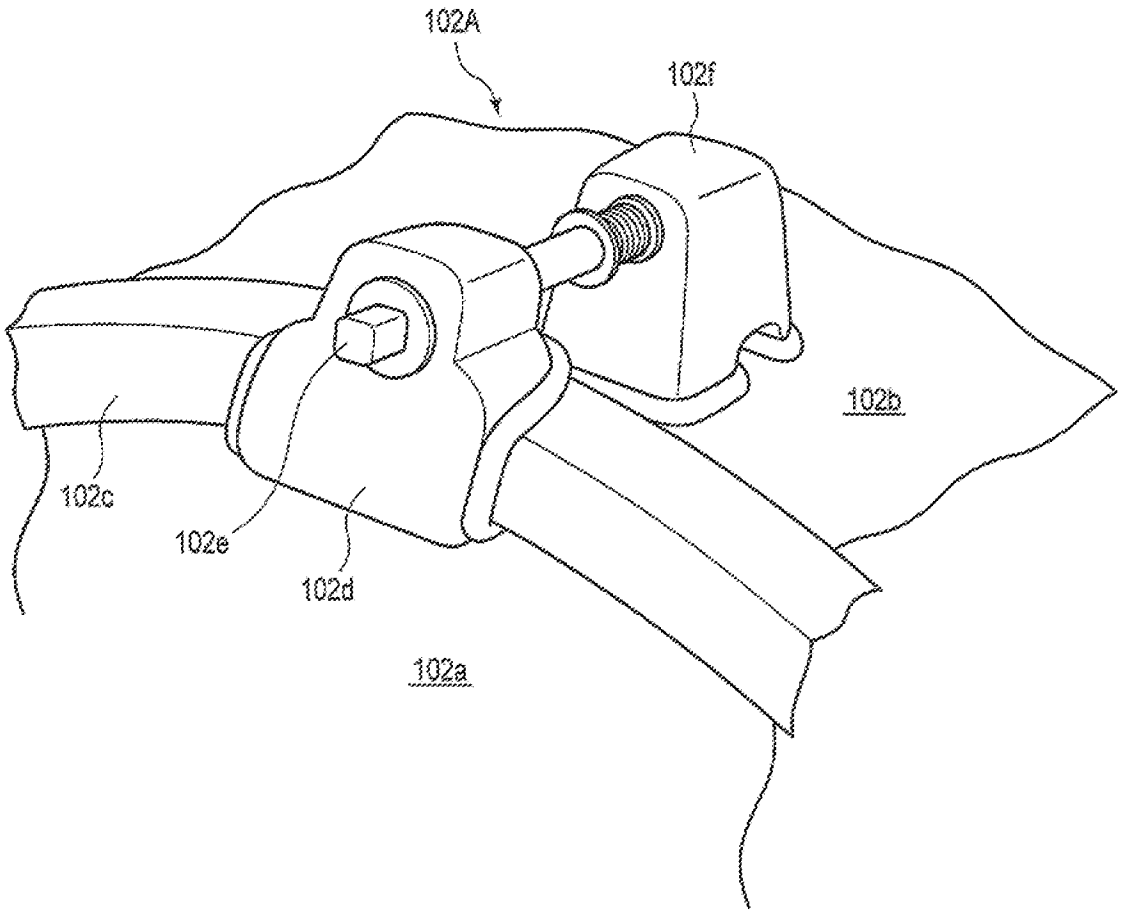
FIG. 3 is a partially-enlarged perspective view showing a fixing member of a hoop of a bass drum shown in FIG. 1.

The bass drum 102 as an acoustic drum includes front and back heads 102*a* (only the front head 102*a* is shown in FIG. 1), a cylindrical shell (body) 102*b*, and front and back circular hoops 102*c*. The head 102*a* is in the form of a rounded sheet, and is attached to fill in an opening portion on the front side of (or on the back side of) the shell 102*b*. An outer rim of the head 102*a* is pressed against the edge of the shell 102*b* by the hoop 102*c*. In this state, the hoop 102*c* is fixedly fastened to the shell 102*b* at a plurality of portions along the rim of the shell 102*b*, using a plurality of fixing members 102A shown in FIG. 3.

When the head 102*a* is attached to the shell 102*b*, the hoop 102*c* is attached to the shell 102*b* in such a manner that the outer rim of the head 102*a* is interposed between the edge of the shell 102*b* and the hoop 102*c*. Hooks 102*d* of the fixing members 102A are attached onto a plurality of portions of the hoop 102*c*, key bolts 102*e* are inserted therethrough, and the key bolts 102*e* are screwed into lugs 102*f* fixed to the shell 102*b*. The lugs 102*f* are provided at equal intervals along the circumferential direction of the shell 102*b*, and are fixed to the shell 102*b* by screws (not shown in the drawings) that penetrate the shell 102*b*.

The bass drum 102 as an acoustic drum is tuned using a tuning key (not shown in the drawings). That is, the key bolt 102*e* of each of the fixing members 102A attached along the hoop 102*c* is turned by a tuning key to adjust the tightness of the head 102*a*. It is thereby possible to change the pitch of the sound produced by the bass drum when beaten with the beater 109*a*. The tuning with the tuning key is performed by tightening the key bolts 102*e* equally and uniformly.

First Embodiment

Figure 4:
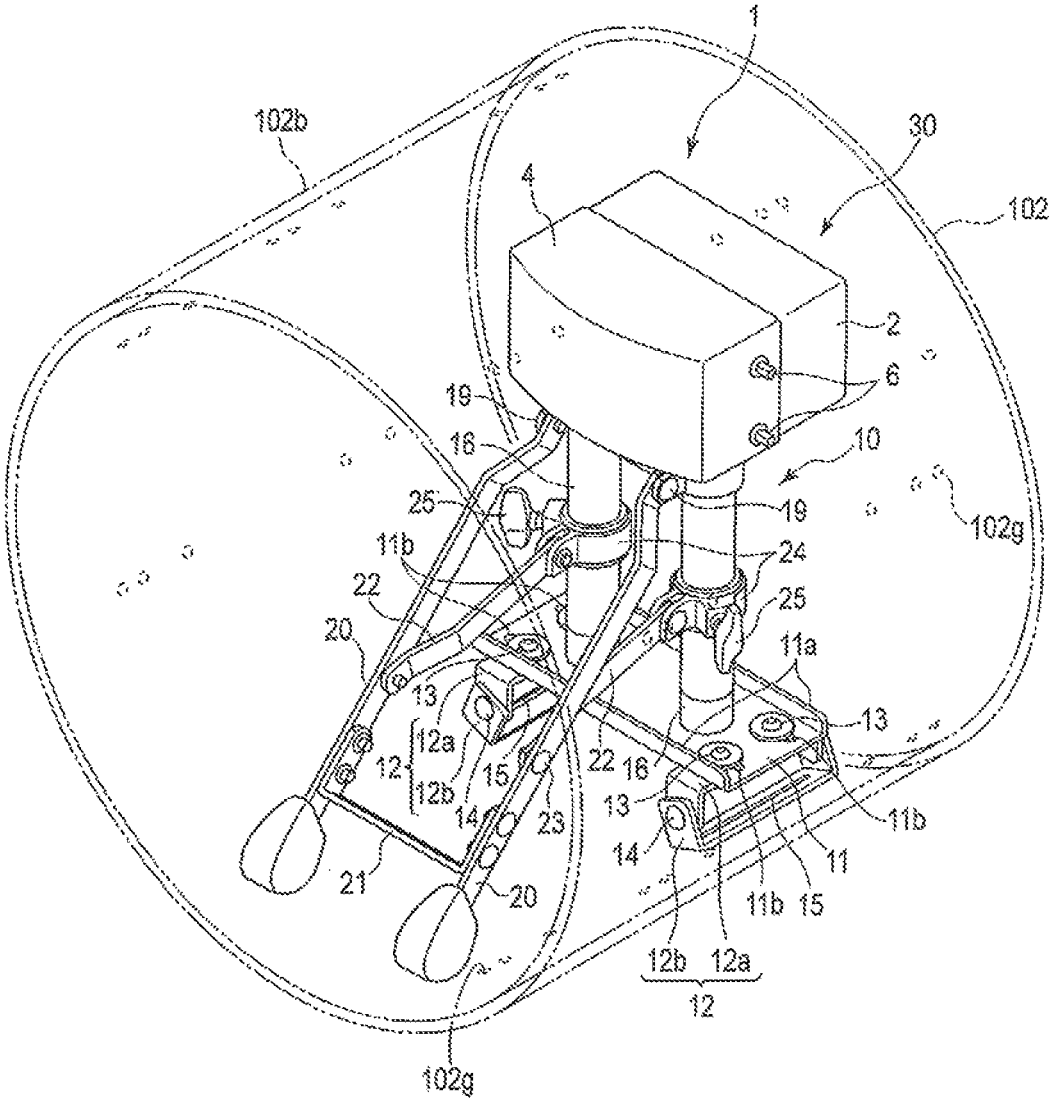
FIG. 4 is a schematic diagram showing a state in which the assembly shown in FIG. 2 is attached to the inside of the bass drum.

Hereinafter, a supporting apparatus 10 according to the first embodiment will be described with reference to FIGS. 2 and 4. FIG. 4 is a schematic diagram showing a state in which an assembly 30 including a kick pad 1 attached to the supporting apparatus 10 is provided inside a bass drum 102. In the description that follows, the direction in which a beater 109*a* beats the kick pad 1 (head 102*a*) will be referred to as a back side (or a rear side). The direction opposite thereto will be referred to as a front side (or an anterior side).

The supporting apparatus 10 includes a bottom plate 11 formed by a substantially rectangular metal plate. The bottom plate 11 includes two ribs 11*a*, which are configured in such a manner that two edge portions provided along its longer-side direction are bent upward (as shown in the drawing) at a substantially right angle. By providing the ribs 11*a*, the stiffness of the bottom plate 11 is increased. The bottom plate 11 is arranged in a substantially horizontal attitude inside the bass drum 102 to face the inner surface at the bottom of the shell 102*b* of the bass drum 102, in such a manner that the two ribs 11*a* are respectively arranged on the front side and the back side, and are oriented upward.

The bottom plate 11 includes four slits 11*b*. Through each of the slits 11*b*, a screw 13 designed to attach two attachment legs 12, which will be described later, to the lower surface side of the bottom plate 11 is inserted. The bottom plate 11 (i.e., the supporting apparatus 10) is fixed to the shell 102*b* of the bass drum 102 via the two attachment legs 12. The two attachment legs 12 function as fixing members of the supporting apparatus 10.

Each slit 11*b* is provided between the two ribs 11*a*, so as to penetrate the bottom plate 11 and extend along the longer-side direction (left-right direction as viewed from the player) of the bottom plate 11. To attach the two attachment legs 12 in such a manner that they are distanced from each other as viewed in the left-right direction (as shown in the drawing), the four slits 11*b* are respectively provided near four corner portions of the bottom plate 11 so as to be distanced from each other as viewed in the longer-side direction of the bottom plate 11.

By attaching attachment legs 12 to the bottom plate 11 using screws 13 inserted through the four slits 11*b*, intervals of the attachment legs 12 as viewed in the longer-side direction (left-right direction as shown in the drawing) of the bottom plate 11 can be adjusted. By means of screws (not shown in the drawings) designed to fixedly fasten the lugs 102*f* of the fixing member 102A to the shell 102*b*, the supporting apparatus 10 of the present embodiment is fixedly fastened to the shell 102*b*, together with the lugs 102*f*, via attachment holes 102*g* (FIG. 4) of the shell 102*b*. Thus, by making the attachment legs 12 movable relative to the bottom plate 11 in the left-right direction (as shown in the drawing), the supporting apparatus 10 of the present embodiment can be attached to the shell 102*b*, regardless of the intervals at which the lugs 102*f* are attached along the circumferential direction of the shell 102*b*.

Each of the two attachment legs 12 includes an upper plate 12*a* on the side of the bottom plate 11 and a lower plate 12*b* on the side of the shell 102*b*. The two attachment legs 12 have the same configuration. The two attachment legs 12 are provided on the lower surface side of the bottom plate 11, near both ends as viewed in the longer-side direction of the bottom plate 11. The attachment legs 12 extend along the shorter-side direction of the bottom plate 11. In other words, the attachment legs 12 extend along the axial direction of the shell 102*b* of the bass drum 102 so as to be distanced from each other in the circumferential direction of the shell 102*b* of the bass drum 102.

The upper plate 12*a* of each of the attachment legs 12 is formed of a belt-like metal plate with both of its ends as viewed in the longer-side direction bent downward (as shown in the drawing) at a substantially right angle. The upper plate 12*a* is arranged in an orientation that allows the upper plate 12*a* to be aligned with the two slits 11*b* arranged along the shorter-side direction of the bottom plate 11. The upper plate 12*a* includes two screw holes (not shown in the drawings) through which the screws 13 are to be inserted. The two screw holes of the upper plate 12*a* are respectively provided in positions that allows the two screw holes to be aligned with the two slits 11*b* of the bottom plate 11. A coupling hole (not shown in the drawings) designed to rotatably couple the lower plate 12*b* to the upper plate 12*a* is provided in each of the bent ends of the upper plate 12*a*.

When the upper plate 12*a* is attached to the bottom plate 11, the upper plate 12*a* is overlapped with the bottom plate 11 so as to face its lower surface. At this time, both ends of the upper plate 12*a* are oriented in a direction (downward direction as shown in the drawing) distant from the bottom plate 11, and the upper plate 12*a* is arranged in an attitude that brings the longer-side direction of the upper plate 12*a* along the shorter-side direction of the bottom plate 11. Also, at this time, the upper plate 12*a* is positioned with respect to the bottom plate 11 in such a manner that two screw holes of the upper plate 12*a* are aligned with the two slits 11*b* of the bottom plate 11.

By inserting the screws 13 into screw holes of the upper plate 12*a* and the slits 11*b* of the bottom plate 11, which are overlapped on one another, the upper plate 12*a* is fixedly fastened to the bottom plate 11 using a nut (not shown in the drawings). At this time, the upper plate 12*a* may be attached at a desired position along the longer-side direction of the bottom plate 11, in accordance with the positions of the lugs 102*f*, within the range of the length of the slits 11*b*.

The lower plate 12*b* is formed of a belt-like metal plate with both of its ends as viewed in the longer-side direction bent at a substantially right angle upward (as shown in the drawing). The lower plate 12*b* is coupled to the upper plate 12*a* in such an attitude that the bent ends are oriented toward the upper plate 12*a*. The bent ends of the lower plate 12*b* are, for example, overlapped with the outer side of the bent ends of the upper plate 12*a*. A coupling hole (not shown in the drawings), which is aligned with the above-described coupling hole of the upper plate 12*a*, is also provided at each of the bent ends of the lower plate 12*b*.

That is, a rotation axis 14 is inserted through the coupling hole of the upper plate 12*a* and the coupling hole of the lower plate 12*b*, which are aligned with each other, and the lower plate 12*b* is coupled to the upper plate 12*a* so as to be rotatable around the rotation axis 14. The rotation axis 14 between the upper plate 12*a* and the lower plate 12*b* extend along the axial direction of the shell 102*b* of the bass drum 102. Accordingly, the lower plate 12*b* is swingable in the circumferential direction of the shell 102*b* of the bass drum 102, relative to the upper plate 12*a*.

The lower plate 12*b* includes a slit 15 that faces the attachment holes 102*g* designed to attach the fixing member 102A of the shell 102*b*. The attachment holes 102*g* of the shell 102*b* are provided in such a manner that two attachment holes 102*g* are provided for each of the lugs 102*f*. The two attachment holes 102*g* constituting a pair are aligned so as to be distant from each other as viewed in the axial direction of the shell 102*b*. The slit 15 of the lower plate 12*b* has a length greater than the interval between the two attachment holes 102*g*, and the position where the lower plate 12*b* is fixed to the shell 102*b* can be adjusted along the axial direction of the shell 102*b*.

When the lower plate 12*b* is attached to the shell 102*b*, the lugs 102*f* are arranged outside the shell 102*b* so as to face the attachment holes 102*g* of the shell 102*b*, and the slit 15 of the lower plate 12*b* is arranged inside the shell 102*b* so as to face the same attachment holes 102*g* in alignment therewith. Screws (not shown in the drawings) are threadably driven into the lugs 102*f* via the slit 15 and the attachment holes 102*g* from inside the shell 102*b*. Thereby, the lower plate 12*b* of the attachment leg 12 is fixedly fastened to the shell 102*b*, together with the lugs 102*f*.

According to the present embodiment, since the lower plate 12*b* is swingable relative to the upper plate 12*a*, the lower plate 12*b* can be adjusted to a desired angle, thus allowing the attachment angle of the lower plate 12*b* to be adjusted in accordance with the curvature of the inner surface of the shell 102*b*. That is, according to the present embodiment, the attachment angle of the attachment leg 12 with respect to the shell 102*b* can be adjusted to a given angle, and the supporting apparatus 10 can be fixed to the shell 102*b* reliably and stably, regardless of the size (radius of curvature) of the bass drum 102.

Also, according to the present embodiment, since the length of the slit 15 of the lower plate 12*b* is made greater than the interval between the two attachment holes 102*g* of the shell 102*b*, the attachment position of the supporting apparatus 10 with respect to the shell 102*b* can be adjusted in the front-back direction. For example, the supporting apparatus 10 is fixed in a position that allows a striking surface cover 2*a* (which will be described later) of the kick pad 1 to be in contact with or in proximity to the head 102*a* on the front side of the bass drum 102.

On the upper surface side (as shown in the drawing) of the bottom plate 11, two main frames (supporting poles) 16 are vertically provided. The two main frames 16 are formed of, for example, metal pipes, and extend upward from the bottom plate 11 substantially parallel to each other. At the lower ends of the main frames 16, screw holes (not shown in the drawings) are coaxially provided. At portions of the bottom plate 11 that face the lower ends of the main frames 16, screw insertion holes (not shown in the drawings) that face the screw holes of the main frames 16 are provided.

When two main frames 16 are fixed to the bottom plate 11, screws 17 (FIG. 2) are inserted therethrough via the screw insertion holes of the bottom plate 11, and are threadably driven into the screw holes provided at the lower ends of the main frames 16. Thereby, the lower ends of the two main frames 16 are fixedly fastened to the bottom plate 11. The kick pad 1 is attached to upper ends (as shown in the drawing) of the two main frames 16.

A sub frame 18 is bridged between the two main frames 16. The sub frame 18 is formed of, for example, a metal plate. Supporting frames 20 are respectively provided on the back side of the main frames 16. The supporting frames 20, each of which is formed of an elongated belt-like metal plate, are bent so as to be tilted in a direction toward each other in the vicinity of the upper ends thereof. The upper end of each of the supporting frames 20 is attached to the corresponding main frame 16 so as to be rotatable around the rotation axis 19 relative to the main frame 16, at a position where the sub frame 18 is connected.

A stopper pin (not shown in the drawings), which is stuck in an inner surface of the shell 102*b* of the bass drum 102 to prevent movement of the supporting apparatus 10 relative to the shell 102*b*, may be provided at a lower end of each of the supporting frames 20, so as to be protrudable therefrom. A connection frame 21 that connects the two supporting frames 20 is attached in the vicinity of the lower ends of the two supporting frames 20. Thereby, the two supporting frames 20 are made integrally rotatable around the rotation axis 19, relative to the main frame 16.

A beam frame 22 is provided between each of the two supporting frames 20 and the corresponding main frame 16. One end 22*a* of the beam frame 22 is rotatably attached to the supporting frame 20 via the rotation axis 23. A slidable sleeve 24 is rotatably attached to the other end 22*b* of the beam frame 22. The slidable sleeve 24 is attached so as to be slidable and rotatable around the main frame 16.

A winged screw 25, which is threadably driven into a screw hole that penetrates the slidable sleeve 24, is attached to the slidable sleeve 24. A bushing 24*a* is provided between the slidable sleeve 24 and the main frame 16. When the winged screw 25 is fastened, a distal end (not shown in the drawings) of the winged screw 25 pushes the bushing 24*a* toward the main frame 16, and the bushing 24*a* is deformed and pressed against the outer peripheral surface of the main frame 16, thereby fixing the slidable sleeve 24 to the main frame 16.

When the slidable sleeve 24 is slid in an up-down direction along the main frame 16, the supporting frame 20 can be rotated around the rotation axis 19, allowing the lower end of the supporting frame 20 to be swung. That is, the distance between the lower end of the supporting frame 20 and the inner surface of the shell 102*b* can be varied by adjusting the position where the slidable sleeve 24 is fixed to the main frame 16.

Thus, when the supporting apparatus 10 is attached to the inside of the bass drum 102 for use, as shown in FIG. 4, it is possible not only to adjust the attachment angle of the attachment legs 12, as described above, but also to adjust the rotation angle of the supporting frames 20. Accordingly, even if the distance between the bottom plate 11 and the inner surface of the shell 102*b* is varied in accordance with the attachment angle or attachment interval of the attachment legs 12, the lower ends of the supporting frames 20 can be made to abut on the inner surface of the shell 102*b*, thereby allowing the supporting apparatus 10 to be attached to the shell 102*b* in a stable state. The kick pad 1 has a configuration in which a pad main body 2 is attached to the anterior side of the case 4. The kick pad 1 of the present embodiment is formed in the shape of a horizontally long, substantially rectangular block, in accordance with a twin pedal (not shown in the drawings) including two beaters 109*a*, which are respectively provided on the right and left.

The pad main body 2 has a configuration in which a stack of a plurality of foamed sheets and sponge sheets (not shown in the drawings) is covered with a striking surface cover 2*a*. The material, the thickness, the number, and the order of arrangement of the foamed sheets and sponge sheets may be suitably varied in accordance with the sound absorption properties and the response properties of the kick pad 1 that are required when the striking surface cover 2*a* of the pad main body 2 is beaten with the beater 109*a*. The material, the thickness, etc. of the striking surface cover 2*a* is selected to achieve a desired rebound when the beater 109*a* beats the striking surface cover 2*a*.

In addition to the above, the pad main body 2 includes a piezoelectric element (not shown in the drawings) inside. The piezoelectric element is an example of a sensor that converts vibration generated by the beater 109*a* by beating the kick pad 1 into an electric signal and outputs the electric signal. An acceleration sensor or a force sensor, for example, may also be used as a sensor that converts the vibration generated by beating the kick pad 1 into an electric signal.

The case 4 includes two opening portions 4*a* through which the upper ends of the two main frames 16 are inserted. The opening portions 4*a* are provided on the lower surface side of the case 4. The opening portions 4*a* are designed to have a size that does not allow the main frame 16 to contact the case 4 of the kick pad 1 when the kick pad 1 is attached to the supporting apparatus 10.

The case 4 is attached to upper ends of the two main frames 16 via four impact-absorbing members 6. The four impact-absorbing members 6 extend in a direction intersecting with the direction of beating of the beater 109*a*. That is, one end of each of the impact-absorbing members 6 is fixed near the upper end of the main frame 16, and the other end is fixed to a sidewall of the case 4. The impact-absorbing members 6 are configured in such a manner that two impact-absorbing members 6 are assigned for the two main frames 16. That is, in the present embodiment, the kick pad 1 is attached to the supporting apparatus 10 via the four impact-absorbing members 6, instead of directly fixing the kick pad 1 to the supporting apparatus 10.

The four impact-absorbing members 6 absorb an impact when the kick pad 1 is beaten by the beater 109*a*, while permitting a subtle movement of the kick pad 1. At this time, the movement of the striking surface (i.e., the striking surface cover 2*a*) of the kick pad 1 is similar to the movement of the head 102*a* when a bass drum 102 as an acoustic drum is beaten. In other words, by attaching the kick pad 1 to the supporting apparatus 10 via a plurality of impact-absorbing members 6, as in the supporting apparatus 10 of the present embodiment, it is possible to have a striking sensation close to that of an acoustic drum.

Also, by attaching the kick pad 1 to the supporting apparatus 10 via a plurality of impact-absorbing members 6, it is possible to reduce the impact sound generated when the kick pad 1 is beaten by the beater 109*a*, thereby reducing the noise. The bottom plate 11, the main frames 16, the sub frame 18, the supporting frames 20, the connection frame 21, the beam frames 22, the slidable sleeves 24, and the four impact-absorbing members 6 function as a supporting member that supports the kick pad 1.

As described above, according to the present embodiment, it is possible to attach a kick pad 1 of an electronic drum to the inside of a bass drum 102 of an acoustic drum, thereby preventing the thickness of the bass drum 102 from increasing in the front-back direction. It is thus possible in the present embodiment to attach the kick pad 1 to an acoustic drum without causing the bass drum 102 from jutting out forward by the thickness of the kick pad 1 and increasing the installation space for the drum set 100.

In the supporting apparatus 10 of the present embodiment, each of the attachment legs 12, which fix the bottom plate 11 to the shell 102*b* of the bass drum 102, includes a lower plate 12*b*, which rotates relative to the upper plate 12*a* in accordance with the curvature of the shell 102*b*. It is thus possible in the present embodiment to fix the kick pad 1 reliably and stably to the curved inner surface of the shell 102*b*.

Also, according to the present embodiment, since the bottom plate 11 includes a slit 11*b* designed to fix the attachment legs 12, it is possible to adjust the attachment positions of the attachment legs 12 along the circumferential direction of the shell 102*b*. Accordingly, the attachment legs 12 can be aligned with the positions of the lugs 102*f* of the shell 102*b*, allowing the supporting apparatus 10 to be fastened together with the lugs 102*f*, using the fixation screws of the lugs 102*f*.

That is, according to the present embodiment, since the attachment holes 102*g* designed to fix the lugs 102*f* to the shell 102*b* of the bass drum 102 are used to fix the attachment legs 12 of the supporting apparatus 10, the lugs 102*f* and the attachment legs 12 can be fastened together to the shell 102*b* using two screws.

This eliminates the necessity to provide, in the bass drum 102, a new attachment hole designed to attach the kick pad 1 to the acoustic drum, and the kick pad 1 can be easily attached to the existing bass drum 102. Moreover, since the screws that fix the attachment legs 12 can also be used as the screws that fix the lugs 102*f*, it is possible to reduce the number of components, resulting in reduction in the manufacturing cost of the apparatus.

Furthermore, according to the present embodiment, since the lower plate 12*b* of each of the attachment legs 12 includes a slit 15 extending in the axial direction of the shell 102*b*, the attachment position of the supporting apparatus 10 can be adjusted along the axial direction of the shell 102*b*. Thus, by using the supporting apparatus 10 of the present embodiment, it is possible to arrange the striking surface of the kick pad 1 in a position that faces the head 102*a* of the bass drum 102.

Second Embodiment

Figure 5:
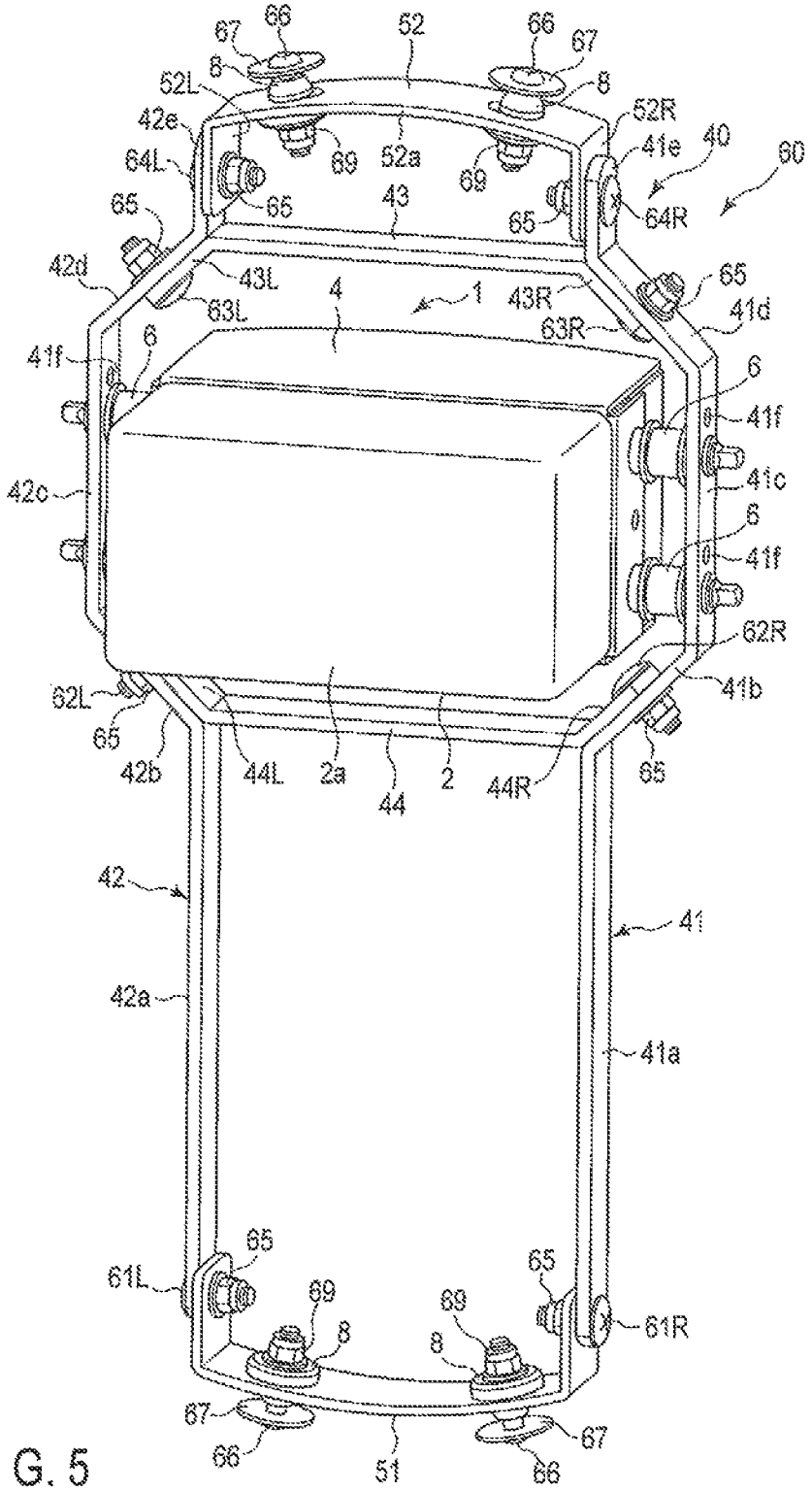
FIG. 5 is an external perspective view showing an assembly in which a kick pad to be installed inside the bass drum shown in FIG. 1 is attached to a supporting apparatus, according to a second embodiment.
Figure 6:
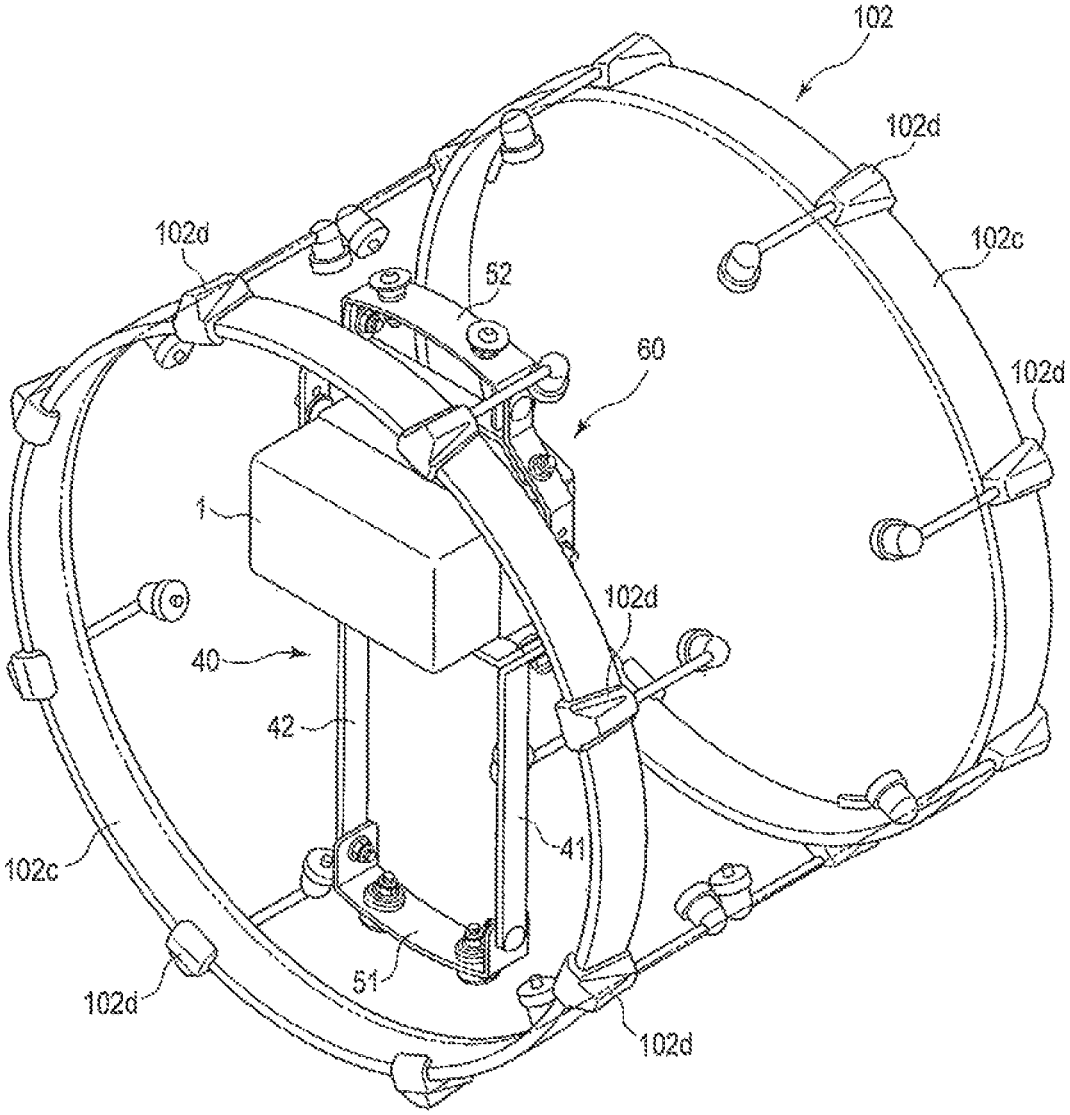
FIG. 6 is a schematic diagram showing a state in which the assembly shown in FIG. 5 is attached to the inside of the bass drum.

FIG. 5 is an external perspective view showing an assembly 60 in which a kick pad 1 is attached to a supporting apparatus 40, according to the second embodiment. FIG. 6 is a schematic diagram showing a state in which the assembly 60 shown in FIG. 5 is attached to the inside of a bass drum 102. In the explanation that follows, the same reference numerals will be added to the constituent elements that function in a manner similar to the above-described first embodiment, and a detailed explanation may be omitted.

The supporting apparatus 40 includes a right supporting frame 41 arranged on the right side of the kick pad 1 as viewed from the player, a left supporting frame 42 arranged on the left side of the kick pad 1, an upper beam frame 43 arranged above the kick pad 1, and a lower beam frame 44 arranged below the kick pad 1. The right supporting frame 41, the left supporting frame 42, the upper beam frame 43, and the lower beam frame 44 function as a supporting member that supports the kick pad 1 in cooperation with the four impact-absorbing members 6. The kick pad 1 is arranged in a space surrounded by the four frames 41-44.

The impact-absorbing members 6 are arranged between the sidewall on the right side (as shown in the drawing) of the case 4 of the kick pad 1 and the right supporting frame 41, and between the sidewall on the left side (as shown in the drawing) of the case 4 and the left supporting frame 42. In contrast to the above-described first embodiment, in which the impact-absorbing members 6 are arranged inside the case 4, the impact-absorbing members 6 are arranged outside the case 4 in the present embodiment. The four impact-absorbing members 6 extend in the left-right direction intersecting with the direction of beating of a beater 109*a*. One end of the impact-absorbing members 6 is fixed to one of the right and left supporting frames 41 and 42, and the other end is fixed to the sidewall of the case 4. The four impact-absorbing members 6 function in a manner similar to those of the above-described first embodiment.

The supporting apparatus 40 includes a lower fixation frame 51 designed to fix the lower ends (as shown in the drawing) of the right supporting frame 41 and the left supporting frame 42 (hereinafter collectively referred to as supporting frames 41 and 42 as well) to the inner surface of the shell 102*b* of the bass drum 102, and an upper fixation frame 52 designed to fix the upper ends (as shown in the drawing) of the supporting frames 41 and 42 to the inner surface of the shell 102*b*. That is, the supporting apparatus 40 of the present embodiment is configured in such a manner that both of its ends as viewed in the up-down direction are fixed to the inner surfaces of the shell 102*b*, so as to connect the inner surfaces of the shell 102*b* of the bass drum 102 that radially face each other.

The lower fixation frame 51 functions as a first fixing member that fixes one end of the supporting frames 41 and 42 to the inner surface of the shell 102*b*, in cooperation with two elastic members 8, which will be described later. The upper fixation frame 52 functions as a second fixing member that fixes the other ends of the supporting frames 41 and 42 to the inner surface of the shell 102*b*, in cooperation with the two elastic members 8, which will be described later. The lower fixation frame 51, the upper fixation frame 52, and the four elastic members 8 function as a fixing member that fixes the lower ends and upper ends of the supporting frames 41 and 42 to the inner surfaces of the shell 102*b* of the bass drum 102.

The right supporting frame 41 is formed of an elongated metal plate with a predetermined width in a shape bent at a plurality of portions. The right supporting frame 41 integrally and continuously includes, from bottom to top as shown in the drawing, a leg portion 41*a*, a lower tilted portion 41*b*, a supporting portion 41*c*, an upper tilted portion 41*d*, and an upper end portion 41*e*.

The leg portion 41*a* extends in the up-down direction (as shown in the drawing), and includes, near its lower end (as shown in the drawing), an insertion hole (not shown in the drawings) through which a screw 61R is inserted. The upper end of the leg portion 41*a* extends to the proximity of the bottom portion of the kick pad 1. The length of the leg portion 41*a* is determined in accordance with the height of the position at which the beater 109*a* beats the kick pad 1. The lower tilted portion 41*b* is tilted outward (diagonally upward right) from the upper end (as shown in the drawing) of the leg portion 41*a*, and extends to the outside of the sidewall of the kick pad 1. The lower tilted portion 41*b* includes an insertion hole (not shown in the drawings) through which a screw 62R is inserted.

The supporting portion 41*c* extends upward (as shown in the drawing) from the upper end of the lower tilted portion 41*b*, along the sidewall of the kick pad 1. The supporting portion 41*c* includes four attachment holes 41*f* designed to attach the impact-absorbing members 6. Two of the four attachment holes 41*f* are used to attach two impact-absorbing members 6. The other two attachment holes 41*f* are used when the attachment position of the kick pad 1 is moved up and down. In FIG. 5, the bottommost attachment hole 41*f* and the third attachment hole 41*f* from the bottom are used to attach the impact-absorbing members 6. When the second attachment hole 41*f* from the bottom and the uppermost attachment hole 41*f* are used to attach two impact-absorbing members 6, the kick pad 1 can be provided at a position slightly above the height shown in the drawing.

The upper tilted portion 41*d* is tilted inward (diagonally upward left) from the upper end (as shown in the drawing) of the supporting portion 41*c*, and extends above the kick pad 1. The upper tilted portion 41*d* includes an insertion hole (not shown in the drawings) through which a screw 63R is inserted. The upper end portion 41*e* extends upward from the upper end of the upper tilted portion 41*d*. The upper end portion 41*e* includes an insertion hole (not shown in the drawings) through which a screw 64R is inserted. The insertion hole of the upper end portion 41*e* may be in the shape of an oval that is vertically long. The length of the upper end portion 41*e* is varied in accordance with the diameter of the bass drum 102.

The left supporting frame 42 is formed of an elongated metal plate with a predetermined width in a shape bent at a plurality of portions. The left supporting frame 42 integrally and continuously includes, from bottom to top as shown in the drawing, a leg portion 42*a*, a lower tilted portion 42*b*, a supporting portion 42*c*, an upper tilted portion 42*d*, and an upper end portion 42*e*. The left supporting frame 42 has a shape that is bilaterally symmetrical to the right supporting frame 41.

The leg portion 42*a* extends in the up-down direction (as shown in the drawing), and includes, near its lower end (as shown in the drawing), an insertion hole (not shown in the drawings) through which a screw 61L is inserted. The upper end of the leg portion 42*a* extends to the proximity of the bottom portion of the kick pad 1. The length of the leg portion 42*a* is determined in accordance with the height of the position at which the beater 109*a* beats the kick pad 1. The lower tilted portion 42*b* is tilted outward (diagonally upward left) from the upper end (as shown in the drawing) of the leg portion 42*a*, and extends to the outside of the sidewall of the kick pad 1. The lower tilted portion 42*b* includes an insertion hole (not shown in the drawings) through which a screw 62L is inserted.

The supporting portion 42*c* extends upward (as shown in the drawings) from the upper end of the lower tilted portion 42*b*, along the sidewall of the kick pad 1. The supporting portion 42*c* includes four attachment holes 41*f* designed to attach the impact-absorbing members 6. Two of the four attachment holes 41*f* are used to attach two impact-absorbing members 6. The other two attachment holes 41*f* are used when the attachment position of the kick pad 1 is moved up and down. In FIG. 5, the bottommost attachment hole 41*f* and the third attachment hole 41*f* from the bottom are used to attach the impact-absorbing members 6.

The upper tilted portion 42*d* is tilted inward (diagonally upward right) from the upper end (as shown in the drawing) of the supporting portion 42*c*, and extends above the kick pad 1. The upper tilted portion 42*d* includes an insertion hole (not shown in the drawings) through which a screw 63L is inserted. The upper end portion 42*e* extends upward from the upper end of the upper tilted portion 42*d*. The upper end portion 42*e* includes an insertion hole (not shown in the drawings) through which a screw 64L is inserted. The insertion hole of the upper end portion 42*e* may be in the shape of an oval that is vertically long. The length of the upper end portion 42*e* is varied in accordance with the diameter of the bass drum 102.

The upper beam frame 43 is formed of an elongated metal plate having the same width as the supporting frames 41 and 42 and having a bent shape. The upper beam frame 43 is provided above the kick pad 1 to extend in the left-right direction (as shown in the drawing). The right and left ends of the upper beam frame 43 are in a shape bent downward (as shown in the drawing) at an obtuse angle. The bend angle of bent portions 43R and 43L at the right and left ends of the upper beam frame 43 is set to the same angle as the tilt angle of the upper tilted portions 41*d* and 42*d* of the supporting frames 41 and 42.

The right and left bent portions 43R and 43L of the upper beam frame 43 are respectively arranged on the inner side of the upper tilted portions 41*d* and 42*d* of the supporting frames 41 and 42 so as to be stacked thereon. The right and left bent portions 43R and 43L of the upper beam frame 43 respectively have insertion holes (not shown in the drawings) through which screws 63R and 63L are inserted.

When the upper beam frame 43 is attached to the supporting frames 41 and 42, the insertion hole of the upper tilted portion 41*d* of the right supporting frame 41 and the insertion hole of the right bent portion 43R of the upper beam frame 43 are aligned to allow the screw 63R to be inserted therethrough, and a nut 65 is threadably fastened thereto. Also, the insertion hole of the upper tilted portion 42*d* of the left supporting frame 42 and the insertion hole of the left bent portion 43L of the upper beam frame 43 are aligned to allow the screw 63L to be inserted therethrough, and a nut 65 is threadably fastened thereto. Thereby, the right end of the upper beam frame 43 is fixedly fastened to the upper tilted portion 41*d* of the right supporting frame 41, and the left end of the upper beam frame 43 is fixedly fastened to the upper tilted portion 42*d* of the left supporting frame 42.

The lower beam frame 44 is formed of an elongated metal plate having the same width as the supporting frames 41 and 42 and having a bent shape. The lower beam frame 44 is provided below the kick pad 1 so as to extend in the left-right direction (as shown in the drawing). The right and left ends of the lower beam frame 44 are in a shape that is bent upward (as shown in the drawing) at an obtuse angle. The bend angle of bent portions 44R and 44L at the right and left ends of the lower beam frame 44 is set to the same angle as the tilt angle of the lower tilted portions 41*b* and 42*b* of the supporting frames 41 and 42.

The right and left bent portions 44R and 44L of the lower beam frame 44 are respectively arranged on the inner side of the lower tilted portions 41*b* and 42*b* of the supporting frames 41 and 42 so as to be stacked thereon. The right and left bent portions 44R and 44L of the lower beam frame 44 respectively has insertion holes (not shown in the drawings) through which screws 62R and 62L are inserted.

When the lower beam frame 44 is attached to the supporting frames 41 and 42, the insertion hole of the lower tilted portion 41*b* of the right supporting frame 41 and the insertion hole of the right bent portion 44R of the lower beam frame 44 are aligned to allow the screw 62R to be inserted therethrough, and a nut 65 is threadably fastened thereto. Also, the insertion hole of the lower tilted portion 42*b* of the left supporting frame 42 and the insertion hole of the left bent portion 44L of the lower beam frame 44 are aligned to allow the screw 62L to be inserted therethrough, and a nut 65 is threadably fastened thereto. Thereby, the right end of the lower beam frame 44 is fixedly fastened to the lower tilted portion 41*b* of the right supporting frame 41, and the left end of the lower beam frame 44 is fixedly fastened to the lower tilted portion 42*b* of the left supporting frame 42.

As described above, by bridging the upper beam frame 43 and the lower beam frame 44 between the right and left supporting frames 41 and 42 and fixing the ends thereof, it is possible to increase the stiffness against torsion in the frame structure of the supporting apparatus 40. By attaching the upper beam frame 43 by bridging the upper tilted portions 41*d* and 42*d* of the right and left supporting frames 41 and 42, and attaching the lower beam frame 44 by bridging the lower tilted portions 41*b* and 42*b* of the supporting frames 41 and 42, as in the present embodiment, the orientations of the screws 62R, 62L, 63R, and 63L provided in the fixation portions of each frame can be varied, thus further increasing the stiffness of the frames against torsion.

The kick pad 1 of the present embodiment has a laterally long shape for compatibility with a twin pedal. Thus, a force that is biased toward the right or left side is apt to act on the kick pad 1, causing a torsional stress to be applied. By adopting a torsion-resistant frame as in the present embodiment, it is possible to provide a supporting apparatus 40 of a kick pad 1 adapted for a twin pedal.

Figure 7:
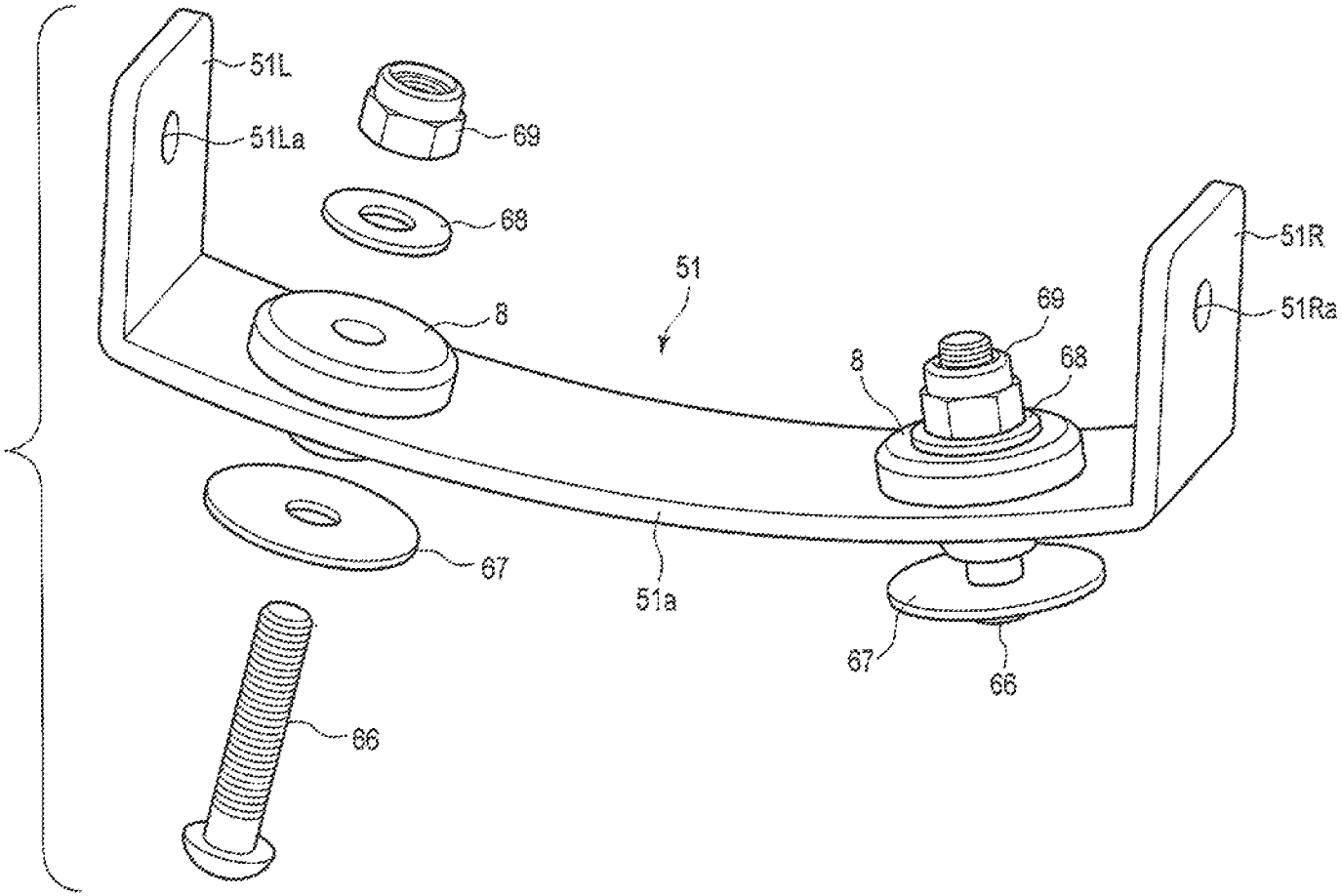
FIG. 7 is a partially-enlarged exploded perspective view showing a lower fixation frame of the supporting apparatus shown in FIG. 5, as well as its fixation structure.

FIG. 7 is an exploded perspective view showing a lower fixation frame 51 designed to fix the lower ends (as shown in the drawing) of the supporting frames 41 and 42 to the shell 102*b* of the bass drum 102, as well as its fixation structure. The lower fixation frame 51 is formed of an elongated metal plate having the same width as the supporting frames 41 and 42 and having a curved and bent shape. The lower fixation frame 51 integrally and continuously includes a right fixation portion 51R at the right end (as shown in the drawing) of the curved portion 51*a*, and integrally and continuously includes a left fixation portion 51L at the left end (as shown in the drawing) of the curved portion 51*a*. The curved portion 51*a* of the lower fixation frame 51 is curved so as to be downwardly convex, in accordance with the curvature of the shell 102*b*. The right and left fixation portions 51R and 51L extend upward toward the lower ends of the supporting frames 41 and 42 from the right and left ends of the curved portion 51*a*.

Two attachment holes (not shown in the drawings), which are distanced from each other as viewed in the left-right direction, are provided in the curved portion 51*a*. Insertion holes 51Ra and 51La, through which the screws 61R and 61L are inserted, are respectively provided in the right and left fixation portions 51R and 51L. When the lower fixation frame 51 is fixed to the lower ends of the supporting frames 41 and 42, the right and left fixation portions 51R and 51L of the lower fixation frame 51 are respectively arranged on the inner side of the right and left supporting frames 41 and 42 so as to be stacked thereon. Then, an insertion hole 51Ra of the right fixation portion 51R of the lower fixation frame 51 and an insertion hole (not shown in the drawings) provided at the lower end of the leg portion 41*a* of the right supporting frame 41 are aligned to allow the screw 61R to be inserted therethrough, and a nut 65 is fastened thereto. Also, the insertion hole 51La of the left fixation portion 51L of the lower fixation frame 51 and an insertion hole (not shown in the drawings) provided at the lower end of the leg portion 42*a* of the left supporting frame 42 are aligned to allow the screw 61L to be inserted therethrough, and a nut 65 is fastened thereto.

Figure 8:
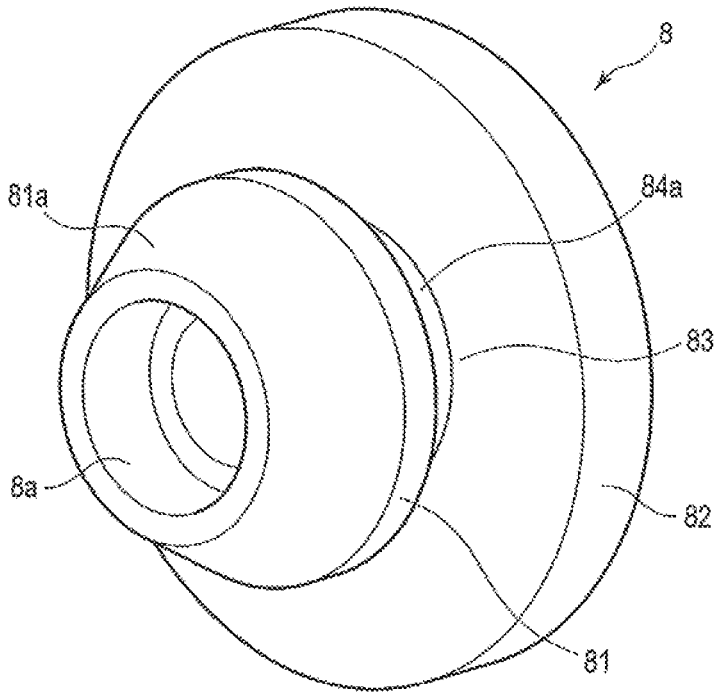
FIG. 8 is a perspective view showing an elastic member shown in FIG. 7.
Figure 9:
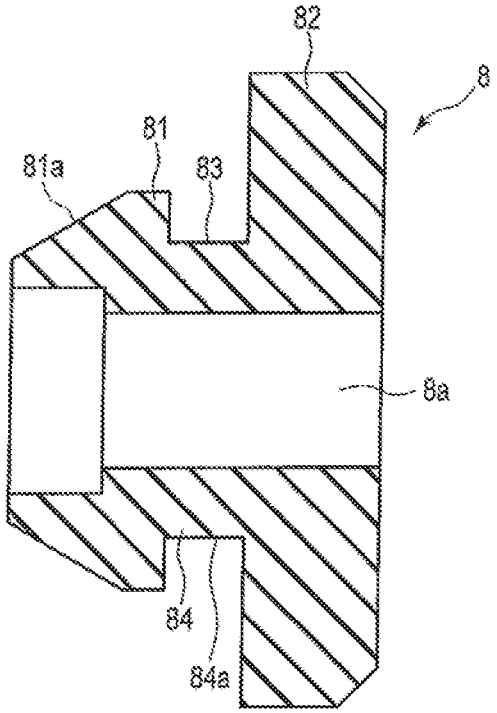
FIG. 9 is a cross-sectional view showing the elastic member shown in FIG. 8.

Elastic members 8 are attached as shown in the drawings, so as to fit in the respective attachment holes provided in the curved portion 51*a*. The elastic members 8 are formed of, for example, rubber. FIG. 8 is a perspective view of the elastic member 8, and FIG. 9 is a cross-sectional view of the elastic member 8. The elastic member 8 includes, at its center, an insertion hole 8*a* through which a screw 66 is inserted. The elastic member 8 is rotationally-symmetrical about the insertion hole 8*a*. The elastic member 8 integrally includes a small-diameter portion 81 and a large-diameter portion 82, which are distanced from each other along the insertion hole 8*a*. A circular attachment groove 83 is provided between the small-diameter portion 81 and the large-diameter portion 82. In other words, the elastic member 8 includes an attachment groove 83 along the outer periphery of an intermediate portion 84 connecting the small-diameter portion 81 and the large-diameter portion 82, and includes an insertion hole 8*a* inside the intermediate portion 84. That is, the outer peripheral surface 84*a* of the intermediate portion 84 becomes a bottom surface of the attachment groove 83.

The small-diameter portion 81 includes a circular tapered surface 81*a* at a distal end distanced from the large-diameter portion 82. The large-diameter portion 82 has a diameter that is large enough to not allow passage through an attachment hole (not shown in the drawings) of the curved portion 51*a*. The outer diameter of the intermediate portion 84 is slightly smaller than the inner diameter of the attachment hole of the curved portion 51*a*. When the elastic member 8 is attached into the attachment hole, the small-diameter portion 81 is pressed into the attachment hole from above the curved portion 51*a*. At this time, the tapered surface 81*a* of the small-diameter portion 81 slidably contacts the edge of the attachment hole, thus reducing the diameter of the small-diameter portion 81. After the small-diameter portion 81 has passed through the attachment hole, the small-diameter portion 81 returns to its original size, and the attachment groove 83 fits in the edge of the attachment hole. In this state, the small-diameter portion 81 protrudes toward the lower surface side of the curved portion 51*a* of the lower fixation frame 51.

When the lower fixation frame 51 with the two elastic members 8 attached thereto is attached to the shell 102*b* of the bass drum 102, screws 66 are inserted through attachment holes (not shown in the drawings) provided in advance in the shell 102*b*, from outside the shell 102*b*. At this time, the screws 66 are inserted through washers 67 arranged on the outer surface side of the shell 102*b*, and then the screws 66 are inserted through the attachment holes. The screws 66 are then inserted through the insertion holes 8*a* of the elastic member 8 fit in the attachment holes (not shown in the drawings) of the lower fixation frame 51 arranged on the inner surface side of the shell 102*b*. On the inner side of the curved portion 51*a*, washers 68 are fit onto the screws 66 protruding via the insertion hole 8*a*, and nuts 69 are threadably fastened thereto. Thereby, the lower fixation frame 51 is fixed to the shell 102*b* via the two elastic members 8.

In this state, the tapered surface 81*a* of the small-diameter portion 81 of the elastic member 8 is pressed against the rim of the attachment hole from inside the attachment hole of the shell 102*b*. The attachment hole (not shown in the drawings) of the shell 102*b* has a diameter slightly greater than the smallest diameter at the distal end side of the small-diameter portion 81, and is slightly smaller than the largest diameter of the small-diameter portion 81. Thus, a halfway portion of the tapered surface 81*a* of the small-diameter portion 81 fits in the edge of the attachment hole, forming a small gap between the lower surface of the curved portion 51*a* and the inner surface of the shell 102*b*. This gap permits a subtle movement, which involves elastic deformation of the elastic member 8, of the supporting apparatus 40 relative to the shell 102*b*. That is, the supporting apparatus 40 elastically supports the kick pad 1 relative to the shell 102*b*.

The upper fixation frame 52 has a configuration in which the lower fixation frame 51 is flipped upside down. The upper fixation frame 52 is formed of an elongated metal plate having the same width as the supporting frames 41 and 42 and having a curved and bent shape. The upper fixation frame 52 integrally and continuously includes a right fixation portion 52R at the right end (as shown in the drawing) of the curved portion 52*a*, and integrally and continuously includes a left fixation portion 52L at the left end (as shown in the drawing) of the curved portion 52*a*. The curved portion 52*a* of the upper fixation frame 52 is curved so as to be upwardly convex, in accordance with the curvature of the shell 102*b*. The right and left fixation portions 52R and 52L extend downward toward the upper ends of the supporting frames 41 and 42 from the right and left ends of the curved portion 52*a*.

Two attachment holes (not shown in the drawings), which are distanced from each other as viewed in the left-right direction, are provided in the curved portion 52*a*. Insertion holes (not shown in the drawings), through which the screws 64R and 64L are inserted, are respectively provided in the right and left fixation portions 52R and 52L. When the upper fixation frame 52 is fixed to the upper ends of the supporting frames 41 and 42, an insertion hole of the right fixation portion 52R of the upper fixation frame 52 and an insertion hole (not shown in the drawings) of the upper end portion 41*e* of the right supporting frame 41 are aligned to allow the screw 64R to be inserted therethrough, and a nut 65 is fastened thereto. Also, the insertion hole of the left fixation portion 52L of the upper fixation frame 52 and the insertion hole (not shown in the drawings) provided at the upper end portion 42*e* of the left supporting frame 42 are aligned to allow the screw 64L to be inserted therethrough, and a nut 65 is fastened thereto.

When the insertion holes provided in the upper end portions 41*e* and 42*e* of the supporting frames 41 and 42 are oval holes that are vertically long, the attachment position of the upper fixation frame 52 may be slightly adjusted as viewed in the up-down direction relative to the upper ends of the supporting frames 41 and 42. In other words, the length of the supporting apparatus 40 of the present embodiment as viewed in the up-down direction can be slightly varied. Thus, the gap between the curved portion 51*a* of the lower fixation frame 51 and the inner surface of the shell 102*b* and the gap between the curved portion 52*a* of the upper fixation frame 52 and the inner surface of the shell 102*b* can be adjusted while the lower fixation frame 51 and the upper fixation frame 52 are attached to the inner surface of the shell 102*b*. This allows the degree of collapse of the elastic member 8 to be changed, and allows the behavior of the kick pad 1 when beaten with the beater 109*a* to be changed, thereby allowing the striking sensation to be changed. Also, according to the present embodiment, the length of the supporting frames 41 and 42 as viewed in the up-down direction can be varied in accordance with the thickness of the shell 102*b*, and the supporting apparatus 40 can be attached to the shell 102*b* with a different thickness.

When the upper fixation frame 52 with the two elastic members 8 attached thereto is attached to the shell 102*b* of the bass drum 102, screws 66 are inserted through attachment holes (not shown in the drawings) provided in advance in the shell 102*b*, from outside the shell 102*b*. At this time, the screws 66 are inserted through washers 67 arranged on the outer surface side of the shell 102*b*, and then the screws 66 are inserted through the attachment holes. The screws 66 are then inserted through the insertion holes 8*a* of the elastic member 8 fit into the attachment holes (not shown in the drawings) of the upper fixation frame 52 arranged on the inner surface side of the shell 102*b*. Inside the curved portion 52*a*, the washers 68 are fit onto the screws 66 protruding via the insertion holes 8*a*, and nuts 69 are threadably fastened thereto. Thereby, the upper fixation frame 52 is fixed to the shell 102*b* via the two elastic members 8.

As described above, according to the present embodiment, it is possible to attach a kick pad 1 of an electronic drum to the inside of a bass drum 102 of an acoustic drum, thereby preventing the thickness of the bass drum 102 from increasing in the front-back direction. It is thus possible in the present embodiment to attach the kick pad 1 to an acoustic drum without causing the bass drum 102 from jutting out forward by the thickness of the kick pad 1 and increasing the installation space for the drum set 100.

In the supporting apparatus 40 of the present embodiment, the lower fixation frame 51 is fixed, via the elastic member 8, to the inner surface of the shell 102*b* with a gap interposed therebetween, and the upper fixation frame 52 is fixed, via the elastic member 8, to the inner surface of the shell 102*b* with a gap interposed therebetween. It is thus possible in the present embodiment to allow the supporting apparatus 40 to move relative to the shell 102*b*.

The kick pad 1 is attached to the supporting apparatus 40 in a floating state via a plurality of impact-absorbing members 6. Thus, the striking sensation of when the kick pad 1 is beaten with the beater 109*a* can be made similar to that of an acoustic drum, and the rebound of the beater 109*a* can be made closer to that of an acoustic drum.

Also, according to the present embodiment, the stiffness of the impact-absorbing members 6 that attach the kick pad 1 to the supporting apparatus 40 and the stiffness of a plurality of elastic members 8 that fix the supporting apparatus 40 to the shell 102*b* can be adjusted. For example, when the stiffness of the elastic member 8 is adjusted, it is only required to adjust the tightness of the screws 66. Thereby, the striking sensation of when the kick pad 1 is beaten with the beater 109*a* can be adjusted, thus improving the user-friendliness.

Also, according to the present embodiment, since the curved portion 51*a* of the lower fixation frame 51 of the supporting apparatus 40 and the curved portion 52*a* of the upper fixation frame 52 of the supporting apparatus 40 are fixed to the inner surface of the shell 102*b* using screws 66 at two positions distanced from each other as viewed in the left-right direction, the screws 66 can be attached in a non-parallel manner. It is thus possible to provide an attachment configuration for a torsion-resistant supporting apparatus 40, and to provide a supporting apparatus 40 of a kick pad 1 adapted for a twin pedal.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the above-described first embodiment, the attachment position of the supporting apparatus 10 is adjusted so as to position the striking surface of the kick pad 1 relative to the head 102*a* of the bass drum 102; however, the configuration is not limited thereto. The head 102*a* is not an essential element, and the striking surface of the kick pad 1 may be directly beaten by the beater 109*a* without interposing the head 102*a* in between. Alternatively, a mesh head, which does not produce sound when beaten, may be attached to the front side of the shell 102*b*, to make the striking sensation of the beater 109*a* preferable.

In the above-described embodiment, explanations have been made with respect to the supporting apparatuses 10 and 40 designed to attach the kick pad 1 to the inside of the bass drum 102; however, the configuration is not limited thereto. For example, the present invention may be applied to an apparatus that fixes, inside the shell 102*b*, a muter (not shown in the drawings), for example, that is brought into contact with the inner surface of the head 102*a* to mute the sound. In this case, the target to which the muter is to be attached is not limited to a bass drum, and the present invention may be applied to an apparatus that attaches a muter to, for example, a snare drum 101 or toms 103, 104, and 105.

In the above-described embodiment, a case has been explained where the kick pad 1 is fixed to the shell 102*b* of the bass drum 102 via the supporting apparatuses 10 and 40; however, the configuration is not limited thereto. The shape of the case 4 of the kick pad 1 may be modified in such a manner that a part of the case 4 is fixed to the inner surface of the shell 102*b*. For example, the case 4 may be provided with a function as a supporting apparatus. In this case, it is desirable that the elastic member 8 is provided between the case 4 and the shell 102*b*.

Furthermore, in the above-described first and second embodiments, a case has been explained where the supporting apparatuses 10 and 40 are configured by a combination of a plurality of frames; however, the configuration is not limited thereto. For example, the supporting apparatuses 10 and 40 may be integrally formed as one frame.

What is claimed is:

1. A supporting apparatus for a kick pad, comprising:

a supporting member that supports a kick pad including a sensor that converts a vibration generated by beating with a beater into an electric signal and outputs the electric signal;

a fixation member that fixes the supporting member to an inner surface of a body of a bass drum while a striking surface of the kick pad is arranged in a position beaten by the beater;

wherein the supporting member has a pair of upright frame members connected at their upper ends to the kick pad;

wherein the fixation member is a curved member having a first end and a second end connected to lower ends of the frame members;

wherein the curved member is mounted to the body of the bass drum through impact absorbing members that elastically support the supporting member; and wherein the impact absorbing members are located on the curved member between the lower ends of the frame members.

2. A supporting apparatus for a kick pad, comprising:

a supporting member that supports a kick pad;

a fixation member that fixes the supporting member to an inner surface of a body of a bass drum;

wherein the supporting member has a pair of upright frame members connected at their upper ends to the kick pad;

wherein the fixation member is a curved member having a first end and a second end connected to lower ends of the frame members;

wherein the curved member is mounted to the body of the bass drum through impact absorbing members that elastically support the supporting member; and wherein the impact absorbing members are located on the curved member between the lower ends of the frame members.

* * * * *